United States Patent [19]

Ikeda

[11] Patent Number: 4,574,997

[45] Date of Patent: Mar. 11, 1986

[54] KEEL AND LOCK FOR WRAPAROUND ARTICLE CARRIER

[75] Inventor: Tamio Ikeda, Tokyo, Japan

[73] Assignee: The Mead Corporation, Dayton, Ohio

[21] Appl. No.: 698,059

[22] Filed: Feb. 4, 1985

[30] Foreign Application Priority Data

May 10, 1984 [CA] Canada ..... 454088

[51] Int. Cl.[4] ..... B65D 65/06

[52] U.S. Cl. ..... 229/40; 206/434; 229/28 BC

[58] Field of Search ..... 229/40, 48 R, 28 BC; 206/427, 434, 140–161

[56] References Cited

U.S. PATENT DOCUMENTS

| | | | |
|---|---|---|---|
| 2,872,036 | 2/1959 | Forrer | 229/40 |
| 3,006,530 | 10/1961 | Forrer | 229/40 |
| 3,223,308 | 12/1965 | Weiss | 229/40 |
| 3,248,004 | 4/1966 | Weiss | 229/40 |
| 3,767,042 | 10/1973 | Ganz | 229/40 |
| 3,828,926 | 8/1974 | Rossi | 206/427 |
| 3,986,658 | 10/1976 | Arneson et al. | 229/40 |
| 4,453,664 | 6/1984 | Oliff | 229/40 |
| 4,526,316 | 7/1985 | Sutherland | 229/40 |

FOREIGN PATENT DOCUMENTS

| | | | |
|---|---|---|---|
| 711599 | 6/1965 | Canada | 229/40 |

*Primary Examiner*—William Price
*Assistant Examiner*—Gary E. Elkins
*Attorney, Agent, or Firm*—Rodgers & Rodgers

[57] ABSTRACT

A keel for a wraparound carrier in which lap panels at the ends of a wrapper blank are secured together in overlapping face contacting relation to form a tubular structure for packaging two rows of articles includes a separating tab struck from the inner lap panel and folded inwardly together with a shouldered locking tab adjoined to the outer one of the lap panels and which is driven through the aperture defined in the inner lap panel by the separating tab so as to cause the locking tab to occupy a position of face contacting relation with the separating tab and with the separating tab and the locking tab disposed in substantially normal relation to the lap panels to form a two-ply keel for separating an article in one row from an oppositely disposed adjacent article disposed in another row.

5 Claims, 4 Drawing Figures

KEEL AND LOCK FOR WRAPAROUND ARTICLE CARRIER

TECHNICAL FIELD

This invention relates to article carriers of the wraparound type and is concerned with an improved keel for such carriers.

BACKGROUND ART

U.S. Pat. No. 2,786,572 issued Mar. 26, 1957 discloses an article carrier of the wraparound type having face contacting lap panels in which locking tabs are struck from the outer lap panel and driven through apertures defined by retaining tabs struck from the inner lap panel so that each locking tab is held in angular propped relation with respect to the lap panels due to engagement with the end of an associated retaining tab.

U.S. Pat. No. 3,381,816 issued May 7, 1968 discloses an article carrier of the wraparound type in which two packaged rows of bottles are separated by a single ply keel panel.

DISCLOSURE OF THE INVENTION

According to this invention in one form, a two ply keel is provided for a wraparound tubular carrier for packaging two rows of articles and which includes overlapping lap panels in which a separating tab is struck from the inner lap panel and folded into normal relation with respect thereto together with a locking tab which is struck from and foldably joined to the outer lap panel and arranged to project through the aperture defined in the inner lap panel by the separating tab so that the locking tab and separating tab are disposed in flat face contacting relation with each other to form a two ply keel structure whereby an article in one row is effectively separated and cushioned from an oppositely disposed adjacent article in another row of articles packaged within the carrier. According to a feature of the invention a locking tab of the punch lock type cooperates with a conventional retaining tab so as to aid in securing the lap panels in flat face contacting relation with respect to each other and so as to hold the wrapper securely about the packaged items thereby to prevent inadvertent dislodgment of the articles through the open ends of the tubular wrapper.

BRIEF DESCRIPTION OF THE DRAWINGS

In the drawings

FIG. 3 is a cross sectional detail view taken along the line designated 3—3 in FIG. 1 and in which;

BEST MODE OF CARRYING OUT THE INVENTION

Figure 1:
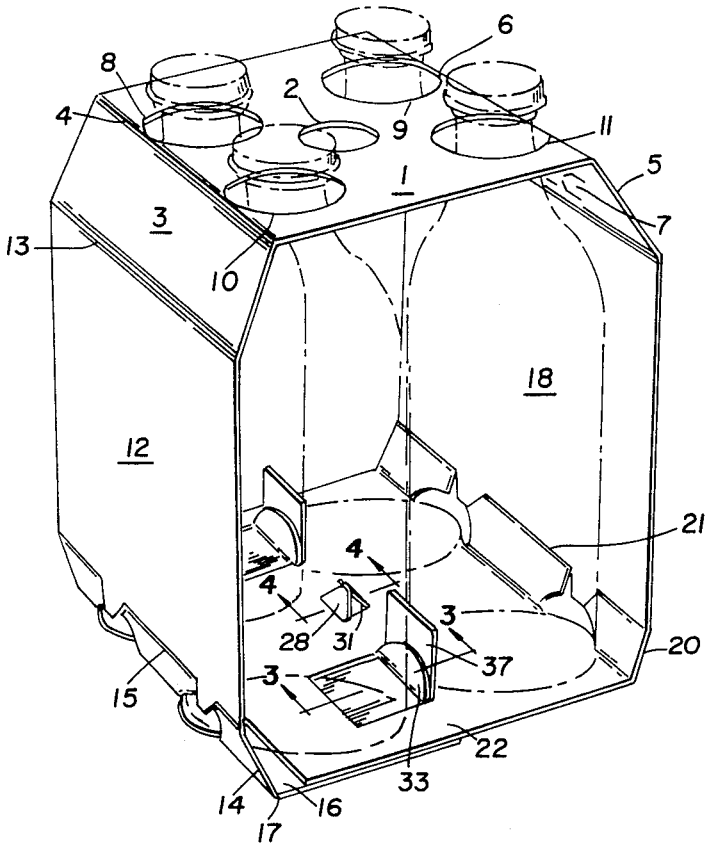
FIG. 1 is a perspective view of a wraparound type carrier in which an improved keel is incorporated and which is formed according to this invention.

In the drawings the numeral 1 designates the top wall of the wrapper and the numeral 2 designates a finger gripping aperture formed in top wall 1 for facilitating portability of the carrier. Sloping shoulder panel 3 is foldably joined to top wall 1 along fold line 4 while sloping shoulder panel 5 is foldably joined to top wall 1 along fold line 6. A conventional tear strip 7 is formed in sloping panel 5 and bottle neck receiving apertures 8, 9, 10 and 11 are arranged so as to receive the upwardly extending necks of bottled packaged within the wrapper.

On one side of the carrier a side wall 12 is foldably joined to sloping panel 3 along fold line 13 and sloping panel 14 is foldably joined to the bottom edge of side wall 12 along fold line 15. Bottom lap panel 16 is foldably joined to sloping panel 14 along interrupted fold line 17.

On the opposite side of the carrier, side wall 18 is foldably joined to the bottom edge of sloping panel 5 along fold line 19 and sloping panel 20 is foldably joined to the bottom edge of side wall 18 along interrupted fold line 21. Lap panel 22 is foldably joined to the bottom edge of sloping panel 20 along interrupted fold line 23.

For receiving the heel portions of packaged articles, apertures 24 and 25 are formed in sloping panel 14 and similar apertures 26 and 27 are formed in sloping panel 20. Panels 24–27 and their associated structure are of conventional well known construction.

Figure 2:
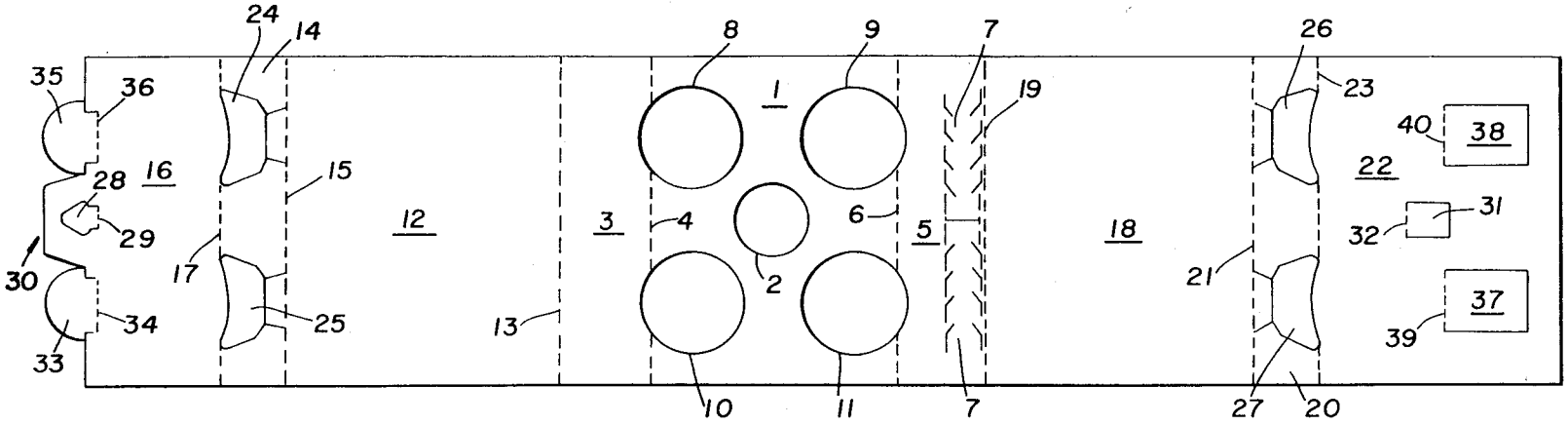
FIG. 2 is a plan view of a generally rectangular wrapper blank from which the carrier of FIG. 1 is formed.

For the purpose of securing outer lap panel 16 in face contacting relation with inner lap panel 22, a punch lock 28 is struck from and foldably joined to lap panel 16 along fold line 29. As is shown in FIG. 2 punch lock 28 is struck in part from a protrusion generally designated by the numeral 30 and which is disposed in coplanar relationship with lap panel 16. For cooperating with punch lock 28, a retaining tab 31 is struck from inner lap panel 22 and is foldably joined thereto along a fold line 32. As is well known and with the lap panels disposed as shown in FIG. 1 and with the bottles disposed within the carrier, punch lock 28 is simply driven through the aperture defined by retaining tab 31 so as to cause the end of retaining tab 31 which is opposite from fold line 32 to engage the punch lock 28 and thereby to hold the punch lock in propped angular disposition relative to the lap panels. By this means the lap panels are effectively secured together.

In order to form a two ply keel structure for separating an article in one row from the adjacent article in the other row, a locking tab such as is designated by the numeral 33 is foldably joined to outer lap panel 16 along fold line 34 and a similar locking tab 35 is foldably joined along fold line 36 to outer lap panel 16.

For receiving the shouldered locking tabs 33 and 35, a pair of apertures are defined in lap panel 22 by separating tabs 37 and 38 which are struck from inner lap panel 22 and are foldably joined thereto along fold lines 39 and 40 respectively.

Figure 3:
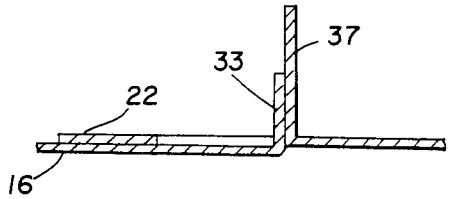
Figure 4:
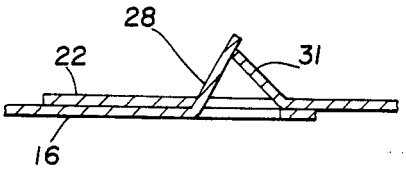
FIG. 4 is a cross sectional detail view taken along the line designated 4—4 in FIG. 1.

Thus with the lap panels disposed as shown in FIG. 1, separating tabs 38 and 39 are simply folded inwardly to occupy positions of substantially normal relation with inner lap panels 22 and the openings defined by these separating tabs then receive the shouldered locking tabs 33 and 35 respectively. As is apparent in FIG. 3, locking tab 33 is disposed in flat face contacting relation with the separating tab 37 and the shouldered locking tab 33 protrudes through the aperture defined in inner lap panel 22 when the separating tab 37 is struck therefrom. Thus as is clear from FIGS. 1 and 3, a two ply keel is formed which comprises shouldered locking tab 33 and separating tab 37. The shoulders of shouldered locking tab 33 are disposed adjacent the inner surface of inner lap panel 22.

Interlocking of the shouldered locking tabs 33 and 35 with the apertures defined in inner lap panel 22 by the separating tabs 37 and 38 aids in securing the lap panels 16 and 22 in face contacting relation with each other thereby to enhance the security of the package and the flat face contacting relation between shouldered locking tabs such as 33 and 35 and the separating tabs such as 37 and 38 provide a two ply cushioning separation between the packaged bottles as is obvious.

INDUSTRIAL APPLICABILITY

This invention is particularly well suited for use in conjunction with wraparound type packages which are especially adapted for packaging bottles. While the invention is well adapted for use in packaging bottles, it is not limited to such application and is feasible for use in connection with packaging of cylindrical items such as chimed cans and the like as is obvious.

I claim:

1. In an article carrier of the wraparound type formed from a blank of generally rectangular configuration and having lap panels at its ends which are overlapped and secured together in flat face contacting relation to form a tubular structure, an improved keel comprising a separating tab struck from the inner one of said lap panels to define an aperture therein and folded inwardly along a medial fold line into a position of substantially normal relation with said inner lap panel, a shouldered locking tab formed on the outer one of said lap panels and foldably joined thereto along a transverse fold line and disposed in substantially normal relation thereto and protruding through said aperture defined in said inner lap panel by said separating tab and in flat face contacting relation with said separating tab to form a two ply keel between adjacent articles in different rows, a retaining tab struck from the inner one of said lap panels to define a locking aperture therein and foldably joined to said inner lap panel along a fold line offset from and generally parallel with the fold line of said separating tab, and a punch lock having a base portion and a pair of shoulders and being struck from the outer one of said lap panels and protruding through said locking aperture with its base portion in engagement with the edge of said locking aperture remote from the fold line of said retaining tab and with its shoulders adjacent the inner surface of said lap panel, the end edge of said retaining tab being in engagement with said punch lock so as to hold said punch lock in propped angular relation to said lap panels.

2. A keel according to claim 1 wherein the shoulders of said locking tab are disposed adjacent the inner surface of said inner lap panel.

3. A keel according to claim 1 wherein said separating tab and said aperture defined thereby are of generally rectangular configuration.

4. A keel according to claim 1 wherein a protrusion is formed on the medial edge of the outer one of said lap panels and wherein said punch lock is struck therefrom.

5. A keel according to claim 1 wherein the base of said punch lock is disposed in substantial alignment with said transverse fold line of said locking tab.

* * * * *